US007591671B2

(12) United States Patent
Kim et al.

(10) Patent No.: US 7,591,671 B2
(45) Date of Patent: Sep. 22, 2009

(54) CONNECTOR FOR DISPLAY DEVICE

(75) Inventors: Sung Hwan Kim, Ulsan-si (KR); Kyu Han Bae, Ulsan-si (KR); Kyu Seob Han, Ulsan-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/602,363

(22) Filed: Nov. 21, 2006

(65) Prior Publication Data

US 2007/0117432 A1 May 24, 2007

(30) Foreign Application Priority Data

Nov. 23, 2005 (KR) ..... 10-2005-0112572

(51) Int. Cl.
*H01R 12/24* (2006.01)

(52) U.S. Cl. ..... 439/495

(58) Field of Classification Search ..... 439/540.1, 439/70, 71–73, 68, 76.1; 361/795
See application file for complete search history.

(56) References Cited

U.S. PATENT DOCUMENTS 3,891,898 A * 6/1975 Damon ..... 361/774
4,004,196 A * 1/1977 Doucet ..... 361/795
4,494,172 A * 1/1985 Leary et al. ..... 361/780
4,859,190 A * 8/1989 Anderson ..... 439/78
4,881,902 A * 11/1989 Papa et al. ..... 439/76.1
5,839,917 A 11/1998 Takahashi et al.
6,027,366 A 2/2000 Mori et al.
6,162,083 A 12/2000 Seto
2005/0252678 A1 11/2005 Lee et al.

FOREIGN PATENT DOCUMENTS

JP 58-132941 A 8/1983
JP 08-180938 7/1996
JP 09-082427 A 3/1997
JP 2000-149668 6/2000
KR 10-2005-00028627 3/2005

* cited by examiner

*Primary Examiner*—Jean F Duverne
(74) *Attorney, Agent, or Firm*—Lee & Morse, P.C.

(57) ABSTRACT

A connector including a body, a plurality of connector pins on the body, at least one dummy pin on the body, and a protective layer covering a portion of each connector pin and a portion of each of the at least one dummy pin, where a contour of the protective layer at a boundary region defines that lengths of uncovered portions, of at least two connector pins, are different.

20 Claims, 3 Drawing Sheets

CONNECTOR FOR DISPLAY DEVICE

BACKGROUND OF THE INVENTION

1. Field of the Invention

The present invention relates to a connector of a display device. More particularly, the present invention relates to a connector of a display device, where the occurrence of cracks in the connector is suppressed and/or prevented.

2. Description of the Related Art

Recently, a variety of display devices have been developed. Some examples of display devices include a liquid crystal display (LCD), a field emission display (FED), a plasma display panel (PDP), an organic light emitting display (OLED) and the like. Given the widespread development of display devices, various devices, e.g., portable phones, personal digital assistants (PDAs), portable DVD players, handheld PCs, and the like, as well as larger size devices, e.g., monitors and televisions, and the like, have incorporated display devices.

For example, a portable phone may employ a dual display device system, where each display device may have its own display panel. The first display device may be an LCD device and the second display device may be an OLED device. This dual display system may require at least one printed circuit board (PCB) to be intervened between the first and second display panels. The at least one PCB may provide a driving signal to the display panels, which may be used to display a predetermined image.

The dual display system may also employ one or more connectors. For example, two connectors may connect the PCB to each display panel. Alternately, this exemplary dual display system may employ two PCBs. Thus, the dual display system may also employ one or more connectors between the two PCBs. While the dual display system discussed above is merely illustrative in nature, it becomes evident that connectors are an important facet to the operation of a device.

FIG. 1 illustrates a schematic of a connector of a display device.

Referring to FIG. 1, the connector 10 may include a body 2, a plurality of connector pins 4, and a protective layer 6. FIG. 1 also illustrates a boundary region 8, which will be discussed in greater detail below.

The body 2 may function as a support for the connector pins 4 and the protective layer 6. The body 2 may be formed of a non-conductive material so it may insulate the connector pins 4 from each other. The body 2 may also be formed of a flexible material to facilitate insertion and withdrawal of the connector 10 from another connector (not illustrated).

The connector pins 4 may be formed on the body 2. The connector pins 4 may be exposed on an end of the body 2. The connector pins 4 may be made from a conductive material.

The protective layer 6 may not cover the entire regions of body 2 and connector pins 4. Rather, the connector pins 4 may be covered on one end of the body 2 and exposed on another end of the body 2. The protective layer 6 may prevent the connector pins 4 from becoming damaged by covering the connector pins 4 in a region where connector pins 4 do not insert into another connector.

The connector 10 may be inserted into an insertion portion of another connector (not illustrated). Upon insertion, the connector pins 4 may be electrically connected to a conductive material formed at the insertion portion of the receiving connector.

However, when connector 10 is inserted into or withdrawn from another connector, it may be prone to cracking in the area of boundary region 8. A crack around boundary region 8 may tend to bend this region of connector 10 more easily, resulting in possible damage to connector pins 4. For example, a crack may begin in the area of boundary region 8 at a side edge of body 2 and traverse inward toward the center of the connector 10.

Regardless of where the crack begins and/or propagates, there is a need to suppress and/or prevent the occurrence of cracks. Further, there is a need to minimize and prevent damage occurring to connector pins 4 so that the operation a display device is maintained.

SUMMARY OF THE INVENTION

The present invention is therefore directed to a connector, which substantially overcomes one or more of the problems due to the limitations and disadvantages of the related art.

It is therefore a feature of an exemplary embodiment of the present invention to provide a connector that may suppress and/or prevent the occurrence of cracks and the spread of cracks.

It is therefore a feature of an exemplary embodiment of the present invention to provide a connector that may prevent damage from occurring to the connector pins.

At least one of the above and other features and advantages of the present invention may be realized by providing a connector of a display device including a body, a plurality of connector pins on the body, at least one dummy pin on the body, and a protective layer covering a portion of each connector pin and a portion of each of the at least one dummy pin, wherein a contour of the protective layer at a boundary region defines that lengths of uncovered portions, of at least two connector pins, are different.

The boundary region may include the contour of a wave shape.

The at least one dummy pin may be outermost relative to the plurality of connector pins. The at least one dummy pin may not be electrically connected to each other.

The at least one dummy pin may include the same material as the plurality of the connector pins.

The body may include a nonconductive material. The shape, size, composition and orientation on the body, of the plurality of the connector pins, may be the same relative to each other. The shape, size, composition and orientation on the body, of the at least one dummy pin, may be the same, relative to each other.

The body may include a flexible material.

The at least one dummy pin may be substantially parallel to the connector pins. The at least one dummy pin may be substantially the same shape as the plurality of connector pins.

At least one of the above and other features and advantages of the present invention may also be realized by providing a connector, including a body, a plurality of pins on the body, and a protective layer covering a portion of each of the pins, the protective layer includes a boundary region that defines what portion of the pins to be covered, and what portion of the pins not to be covered, wherein a contour of the boundary region provides that an uncovered length of at least two pins, are different.

The contour of the boundary region may be oriented at any angle.

The plurality of pins may include at least one connector pin and at least one dummy pin. The at least one dummy pin may be outermost relative to the at least one connector pin. The at least one dummy pin may be on the body in symmetric fashion.

The at least one dummy pin and the at least one connector pin may include the same material. The at least one connector pin may include conductive material.

The body may include non-conductive material.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Korean Patent Application No. 10-2005-112572, field on Nov. 23, 2005, in the Korean Intellectual Property Office, and entitled: "Connector for Portable Display Device," is incorporated by reference herein in its entirety.

The present invention will now be described more fully hereinafter with reference to the accompanying drawings in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of the elements and regions may be exaggerated for clarity of illustration. It will also be understood that when an element is referred to as being "on" another element, it can be directly on the other element or intervening elements may also be present. Further, it will be understood that when an element is referred to as being "under" another element, it can be directly under, and one or more intervening elements may also be present. In addition, it will also be understood that when an element is referred to as being "between" two elements, it can be the only element between the two elements, or one or more intervening elements may also be present. In addition, it will also be understood that when an element is referred to as being "covered," it can be the only element covered, or one or more intervening elements may also be present.

Exemplary embodiments with which the skilled person pertaining to the art can implement the present invention easily will be described in detail by referring to FIG. 2, FIG. 3A and FIG. 3B.

Figure 2:
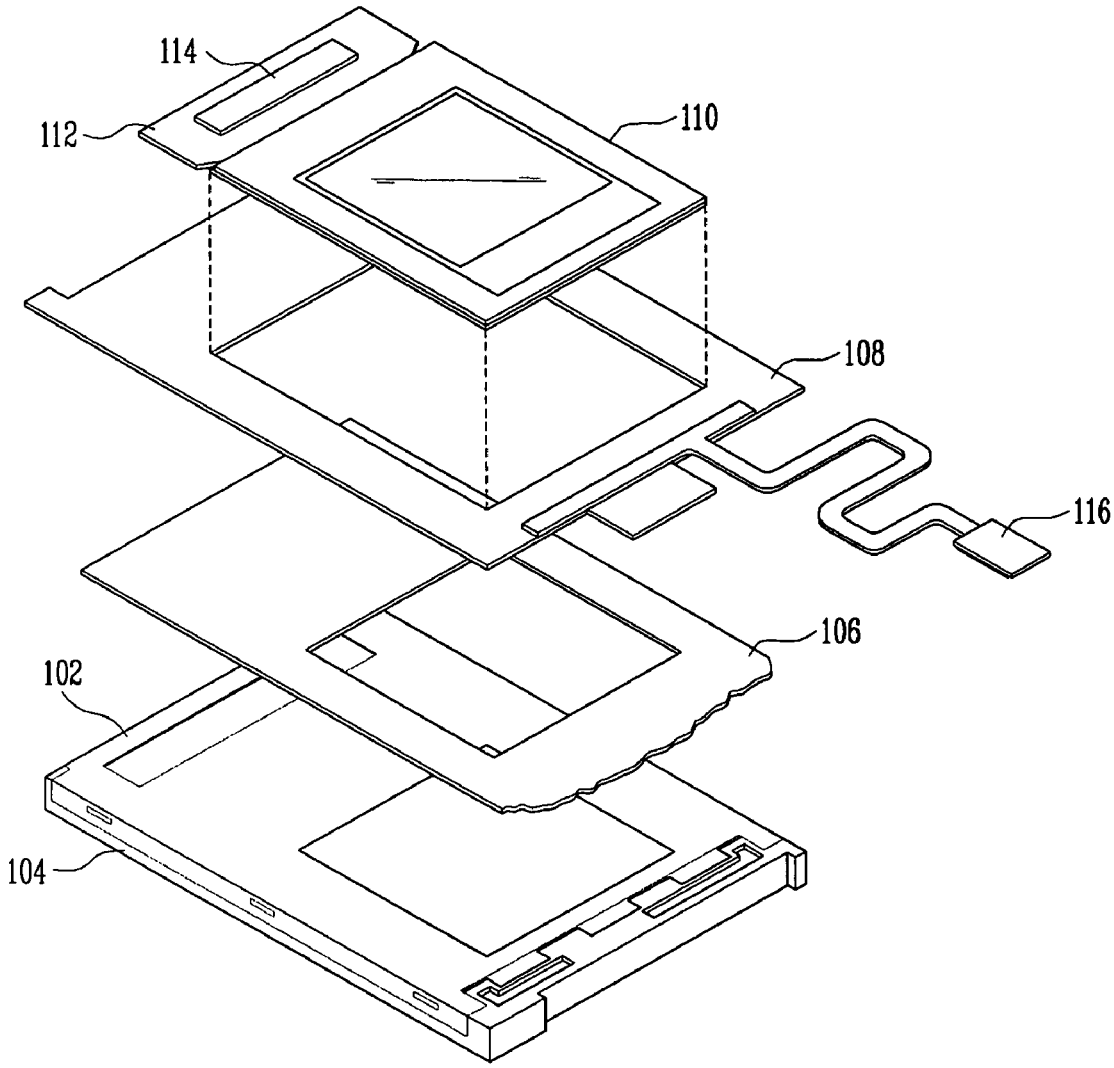
FIG. 2 illustrates an exploded view of a display device according to an exemplary embodiment of the present invention.

FIG. 2 illustrates an exploded view of a display device according to an exemplary embodiment of the present invention. Although FIG. 2 illustrates a dual display panel system, the present invention is not intended to be limited to this system or structure. That is, the present invention is not intended to be limited to any particular type of display device, or for that matter, any type of device. As will be understood more clearly upon further discussion, the connector of the present invention may be employed in any device.

Referring to FIG. 2, the display device according to an exemplary embodiment of the present invention may include a bottom chassis 102, a mold frame 104, a first PCB 106, a second PCB 108, a second display panel 110, a third PCB 112, an integrated circuit 114, and a connector 116. Although not illustrated, a first display panel and backlight assembly may be received by the bottom chassis 102. For discussion purposes only, an LCD device may include the first display panel and backlight assembly and an OLED device may include the second display panel.

The bottom chassis 102 may receive a first display panel and backlight assembly (not illustrated). The bottom chassis 102 may be attached to the mold frame 104. The first display panel may be selected as a LCD panel.

A device, e.g., a portable phone (not illustrated), may include a driving circuit (not illustrated). The driving circuit of the portable phone may generate various driving signals to the second PCB 108 via connector 116. The first PCB 106 may be electrically connected to the second PCB 108. The first PCB 106 may receive signals from the second PCB 108 to drive the first display panel (e.g., the LCD panel) supported by the bottom chassis 102. Although not illustrated, the connection between the first PCB 106 and the second PCB 108, as well as the connection between the first PCB 106 and the first display pane may be employed using the connector of the present invention.

The second display panel 110 may be connected to a third PCB 112 and an integrated circuit 114. The third PCB 112 may be connected to the first PCB 106 and/or the second PCB 108. The third PCB 112 may receive signals from the first PCB 106 and/or the second PCB 108 and output signals to the integrated circuit 114. The integrated circuit 114 may drive the second display panel 110 (e.g., the OLED panel) to display a certain image in correspondence to the signals supplied thereto. Although not illustrated, the connections between the PCBs 106, 108, 112, the integrated circuit 114 and the second display panel 110 may be employed using the connector of the present invention.

Figure 3A:
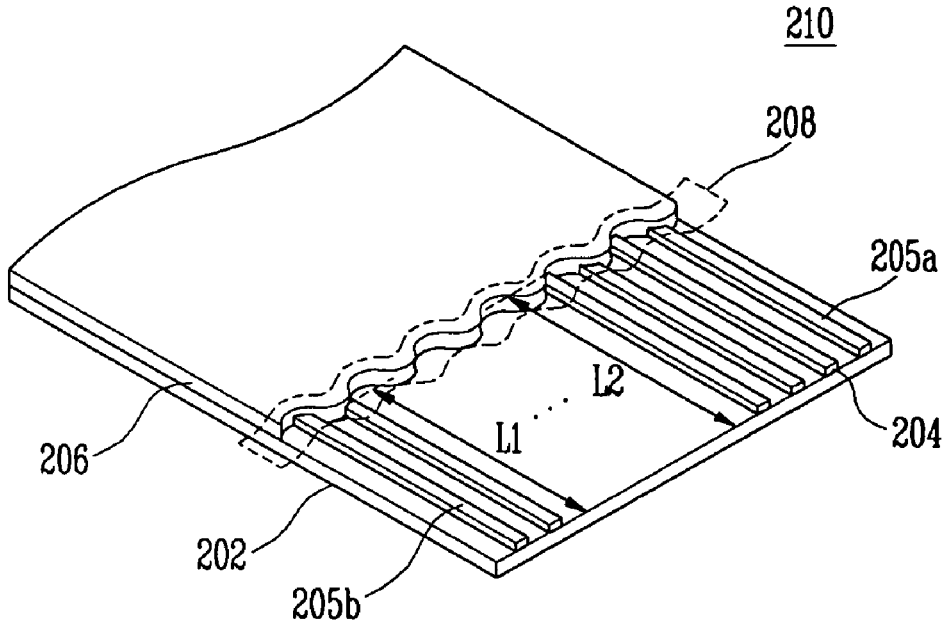
FIGS. 3A and 3B illustrate schematics of the connector according to an exemplary embodiment of the present invention.
Figure 3B:
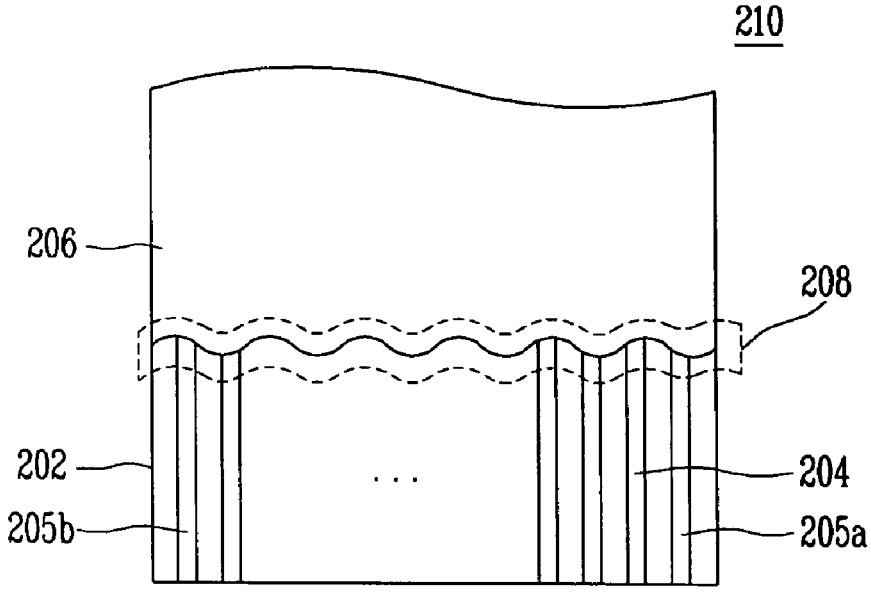

FIGS. 3A and 3B illustrate schematically the connector according to an exemplary embodiment of the present invention.

Referring to FIGS. 3A, 3B, the connector 210 may include a body 202, a plurality of connector pins 204 formed on the body 202, dummy pins 205*a*, 205*b* formed on the body, and a protective layer 206, which protects portions of the connector pins 204 and the dummy pins 205*a*, 205*b*. FIGS. 3A and 3B also illustrate a boundary region 208, which will be discussed in greater detail below.

The body 202 may function as the support for the connector pins 204, dummy pins 205*a*, 205*b* and the protective layer 206. The body 202 may be formed of a flexible material, which may facilitate the process of the connector 210 being inserted into or withdrawn from another connector (not illustrated). Additionally, the body 202 may be formed of a non-conductive material so it may insulate the connector pins 204 from each other.

The connector pins 204 may be formed on the body 202. The connector pins 204 may be formed of a conductive material. Although FIGS. 3A and 3B illustrate a plurality of connector pins 204, each identical to the other, in terms of shape, size, orientation on the body 202, etc., the present invention should not be limited to this implementation. Rather, the placement, orientation, composition, shape, size and the like of the connector pins 204 could be different, not only from FIGS. 3(*a*) and 3(*b*), but also from each other, respectively. Therefore, the exemplary embodiments discussed and illustrated herein as it relates to the connector pins should not limit the scope of this invention.

Dummy pins 205*a*, 205*b* may be formed on the body 202. Dummy pin 205*a* and dummy pin 205*b* may be formed on respective side edges of the body 202 or outermost relative to the connector pins 204. The dummy pins 205*a*, 205*b* may be formed of the same material as the connector pins 204. The dummy pins 205*a*, 205*b* may not electrically connect to each other. Although FIGS. 3A and 3B illustrate dummy pins 205*a*, 205*b* disposed on respective side edges of body 202, the present invention should not be limited to this implementation. Rather, the number, placement, composition, shape and size of the dummy pins on the body of the connector could be different, not only from FIGS. 3A and 3B, but from each other, respectively. Therefore, the exemplary embodiments discussed and illustrated herein as it relates to the dummy pins should not limit the scope of this invention.

A protective layer 206 may be formed so that it covers portions of the connector pins 204 and the dummy pins 205*a*, 205*b*. That is, some portion of the connector pins 204 and dummy pins 205*a*, 205*b* may be exposed, while another portion of connector pins 204 and dummy pins 205*a*, 205*b* may be covered.

Although FIGS. 3A and 3B illustrate that nearly half the length of connector pins 204 and dummy pins 205*a*, 205*b* may be exposed and the other half of the length may be protected by the protective layer 206, the present invention should not be limited to this implementation. The contour of the protective layer 206 at the boundary region 208 will be discussed in greater detail below. However, it should be noted that the exemplary embodiments discussed herein as it relates to this element should not limit the scope of this invention.

In one implementation, as illustrated in FIGS. 3A and 3B, the contour of the protective layer 206 at the boundary region 208 may be formed in the shape of a wave. In this implementation, the protective layer 206 may be formed so that the lengths by which at least two of the connector pins 204 are exposed are different from each other. For example, a particular connector pin 204 has an exposed length of L1, whereas another connector pin 204 has an exposed length of L2, where L2 may be a different length than L1.

Although FIGS. 3A and 3B illustrate the protective layer 206 at the boundary region 208 in the shape of a wave, the present invention should not be limited to this implementation. Rather, a myriad of shapes or contours for the protective layer 206 at the boundary region 208 exist.

Figure 1:
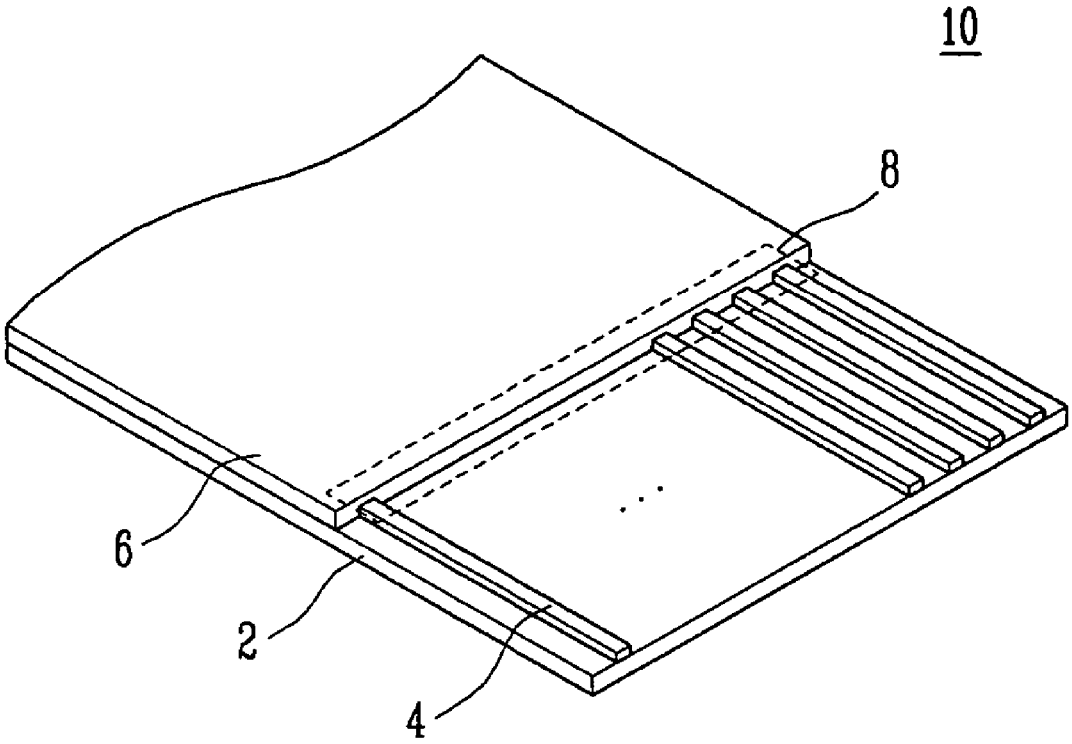
FIG. 1 (RELATED ART)
FIG. 1 illustrate a schematic of a connector of a display device.

As discussed above with respect to FIG. 1, the boundary region 208 of the protective layer 206 may be in the shape of a straight line. This shape, however, may more readily facilitate the propagation of a crack. Therefore, any contour that may not be a straight line may be considered as a possible contour of the boundary region 208. For example, unlike the wave shape as illustrated in FIGS. 3A and 3B, the contour may not be periodic. Rather, the contour may have an aperiodic shape, or it may be a combination of a periodic and aperiodic shape. Further, the shape of the contour may be symmetric or asymmetric, etc.

As discussed above, if a crack should occur, we wish to preserve the integrity of the connector pins 204. Accordingly, if the shape of the boundary region 208 provides that the lengths of at least two of the connector pins 204 that are exposed are different from each other, then the integrity of at least one connector pin 204 may be preserved. That is, the shape of the boundary region 208 may suppress and/or prevent the propagation of the crack.

Considering the process of inserting the connector 210 into another connector, if a crack should occur, for example, beginning at the side edge of body 2, connector pins 204 may not be susceptible to damage. Rather, the crack may occur mainly on the dummy pins 205*a*, 205*b* disposed on the side edges of the body 202. A similar extrapolation may be considered during the process of withdrawing the connector 210 from another connector.

As illustrated and discussed above, the protective layer 206 may be formed in the shape of a wave, at the boundary region 208, and the connector pins 204 may be inserted, the pressure applied to the boundary region 208 may not be concentrated in one region of the connector 210. Rather, the pressure may be spread out, thus it may suppress and/or prevent the occurrence of cracks that may be formed on the connector pins 204 and the dummy pins 205*a*, 205*b*. That is, protective layer 206 at the boundary region 208, may not tend to bend so easily. Hence, the occurrence of a crack may be suppressed and/or prevented, which may result in preserving the proper operation of a device. Additionally, if a crack should occur, the integrity of the connector pins 204 may be preserved by the addition of dummy pins 205*a*, 205*b*.

As discussed above, the connector employable by a display device, according to an exemplary embodiment of the present invention, may suppress and/or prevent the occurrence of a crack, which may result in the proper operation of the device, by forming the boundary region of the protective layer in the shape of, e.g., a wave. Furthermore, dummy pins may be added on the side edges of the body, or other suitable areas on the body, which may prevent cracks from damaging the connector pins at the boundary region.

As discussed above, a connector according to an exemplary embodiment of the present invention may suppress and/or prevent the occurrence of a crack, which may result in a proper connection, by forming the boundary region of the protective layer in the shape of, e.g., a wave. Furthermore, dummy pins may be added on the side edges of the body, or other suitable areas on the body, which may prevent cracks from damaging the connector pins at the boundary region.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A connector of a display device, comprising:

a body;

a plurality of connector pins on the body along a horizontal direction, the horizontal direction being parallel to a lengthwise direction of the body;

at least one dummy pin on the body along the horizontal direction; and a protective layer covering a portion of each connector pin and a portion of each of the at least one dummy pin, wherein a contour of the protective layer at a boundary region defines that lengths of uncovered portions of at least two connector pins along the horizontal direction are different.

2. The connector of a display device as claimed in claim 1, wherein the boundary region includes the contour of a wave shape.

3. The connector of a display device as claimed in claim 1, wherein the at least one dummy pin is outermost relative to the plurality of connector pins.

4. The connector of a display device as claimed in claim 1, wherein the at least one dummy pin is not electrically connected to each other.

5. The connector as claimed in claim 1, wherein the at least one dummy pin includes the same material as the plurality of the connector pins.

6. The connector of a display device as claimed in claim 1, wherein the body includes a nonconductive material.

7. The connector of a display device as claimed in claim 1, wherein the shape, size, composition and orientation on the body, of the plurality of the connector pins, are the same relative to each other.

8. The connector of a display device as claimed in claim 1, wherein the shape, size, composition and orientation on the body, of the at least one dummy pin, is the same, relative to each other.

9. The connector of a display device as claimed in claim 1, wherein the body includes a flexible material.

10. The connector of a display device as claimed in claim 1, wherein the at least one dummy pin is substantially parallel to the connector pins.

11. The connector of a display device as claimed in claim 1, wherein the at least one dummy pin is substantially the same shape as the plurality of connector pins.

12. A connector, comprising:

a body;

a plurality of pins on the body along a horizontal direction, the horizontal direction being parallel to a lengthwise direction of the body; and a protective layer covering a portion of each of the pins, the protective layer includes a boundary region that defines what portion of the pins to be covered, and what portion of the pins not to be covered, wherein a contour of the boundary region provides that an uncovered length of at least two pins along the horizontal direction are different.

13. The connector as claimed in claim 12, wherein the contour of the boundary region may be oriented at any angle.

14. The connector as claimed in claim 12, wherein the plurality of pins include at least one connector pin and at least one dummy pin.

15. The connector as claimed in claim 14, wherein the at least one dummy pin is outermost relative to the at least one connector pin.

16. The connector as claimed in claim 14, wherein the at least one dummy pin is on the body in symmetric fashion.

17. The connector as claimed in claim 14, wherein the at least one connector pin includes conductive material.

18. The connector of a display device as claimed in claim 1, wherein a plane of the contour of the protective layer is perpendicular to a plane supporting the body.

19. The connector of a display device as claimed in claim 1, wherein each of the connector pins and the dummy pins is entirely above the body and on an upper surface of the body.

20. The connector of a display device as claimed in claim 19, wherein the protective layer is covering upper surfaces of the connector pins and of the dummy pins, the connector pins and dummy pins being between the protective layer and the upper surface of the body.

* * * * *